United States Patent [19]

Efferding

[11] Patent Number: 5,063,299

[45] Date of Patent: Nov. 5, 1991

[54] LOW COST, MINIMUM WEIGHT FUEL ASSEMBLY STORAGE CASK AND METHOD OF CONSTRUCTION THEREOF

[75] Inventor: Larry E. Efferding, Richland, Wash.

[73] Assignee: Westinghouse Electric Corp., Pittsburgh, Pa.

[21] Appl. No.: 553,515

[22] Filed: Jul. 18, 1990

[51] Int. Cl.[5] ..... G21F 5/00

[52] U.S. Cl. ..... 250/507.1; 376/272

[58] Field of Search ..... 250/507.1, 506.1; 376/272

[56] References Cited

U.S. PATENT DOCUMENTS

| | | | |
|---|---|---|---|
| 3,119,933 | 1/1964 | Allen | 250/507.1 |
| 4,274,007 | 6/1981 | Baatz et al. | 250/506 |
| 4,445,042 | 4/1984 | Baatz et al. | 250/506.1 |
| 4,633,091 | 12/1986 | Kursch et al. | 250/506.1 |
| 4,636,645 | 1/1987 | Kessinger | 250/506.1 |
| 4,711,758 | 12/1987 | Machado et al. | 376/272 |
| 4,781,883 | 11/1988 | Daugherty et al. | 376/272 |

FOREIGN PATENT DOCUMENTS

| | | | |
|---|---|---|---|
| 2831646 | 7/1978 | Fed. Rep. of Germany | 250/507.1 |
| 3306940 | 9/1983 | Fed. Rep. of Germany | 376/272 |
| 0272981 | 11/1989 | German Democratic Rep. | 250/506.1 |
| 59-37499 | 2/1984 | Japan . | |
| 61-162799 | 7/1986 | Japan | 250/506.1 |

*Primary Examiner*—Jack J. Berman

[57] ABSTRACT

A low cost, minimum weight cask for the storage of fuel assemblies is disclosed herein, along with a method for the construction thereof. The cask generally comprises a wall assembly for defining a cask interior that is complementary in shape to a rectangular array of radioactive fuel assemblies that is formed from four flat, metallic wall plate members having mutually parallel side edges which are adjoined be welds that penetrate only part way through the thicknesses of the wall plate members. The cask further includes a floor plate attached to the bottom of the wall assembly, and a lid that is detachably connectable to the top of the wall assembly. A basket assembly formed from parallel and uniformly spaced plates of borated aluminum interconnected in "egg crate" fashion is disposed in the rectangular interior of the cask. To minimize weight, each of the corners of the wall assembly is truncated. Mutually adjacent and adjoined side edges of two different wall plate members include mutually interfitting portions for avoiding the creation of a streaming path for radiation. The use of welds to adjoin the side plate members that penetrate only a fraction of the thickness of these members, in combination with the rectangular shape of the cask and the truncated corners thereof results in a low cost, minimum weight storage cask for fuel assemblies.

40 Claims, 4 Drawing Sheets

LOW COST, MINIMUM WEIGHT FUEL ASSEMBLY STORAGE CASK AND METHOD OF CONSTRUCTION THEREOF

BACKGROUND OF THE INVENTION

This invention generally relates to storage casks, and is specifically concerned with a low cost, minimum weight cask for storing spent fuel assemblies on the facilities of a nuclear power generating station.

Casks for the transportation and storage of radioactive materials such as spent fuel assemblies are known in the prior art. Such casks generally comprise a cylindrical inner container integrally formed from cast iron, as well as an outer container which may be formed from steel. A plurality of radially extending fins is often provided around the perimeter of the outer container for dissipating the heat generated by the breakdown of the radioactive isotopes in the spent fuel. Additionally, a layer of neutron-absorbing material such as a high-hydrogen concrete or a polyurethane material is disposed between the inner and outer containers for absorbing any neutron radiation which may be emitted by the spent fuel assemblies. Finally, a removable basket assembly is typically provided within the interior of the inner container for both spacing and arranging the spent fuel assemblies disposed therein. In the prior art, such basket assemblies are formed from sheets of stainless steel which have been welded together to form an array of cells for receiving the spent fuel assemblies. To insure that no critical nuclear reactions will occur between adjacent fuel assemblies, these stainless steel sheets are often laminated with sheets of boron for poisoning any such reaction. Additionally, flux traps formed from two, spaced apart parallel plates are also provided between every interface of every two adjacent fuel assemblies to minimize the amount of thermal neutron flux radiated between the fuel assemblies.

In the past, such casks have been designed with the twin objectives of fulfilling both the storage and transportation criteria set forth by the Nuclear Regulatory Commission (NRC) in various federal regulations. In order to fulfill the storage criteria, the surface radiation of all such casks may be no greater than about 200 millirems per hour at any given point. Additionally, the cask must be capable of effectively rejecting the heat of decay generated by the spent fuel assemblies within it. If no effective heat rejection mechanism were provided, the temperature within the cask could become high enough to generate dangerous levels of pressure, particularly if water became present in the interior of the cask. In order to fulfill the transportation criteria, the NRC regulations maintain that the cask must be capable of withstanding the mechanical shock of a magnitude commensurate with that of a hypothetical vehicular accident that applies momentary forces to the cask of approximately 150 G's, simulated by dropping the cask from a distance of 9 meters upon a non-yielding surface. In this regard, it is not enough that the walls of the cask continue to contain the radioactive material after such a mechanical shock. They must further maintain water tightness at all points so that external water will not have an opportunity to leak into the interior of the cask and thermalize the neutrons being emitted by the spend fuel rods. Additionally, the basket structure within the cask must be capable of withstanding the approximate 150 G forces applied to its perimeter by the inner cask walls without any significant distortion of its individual, waste containing cells. If these cells did undergo such distortion, the effectiveness of the neutron traps installed between the cells could be jeopardized, which in turn might result in a criticality condition within the cask.

To simultaneously solve these two criteria, the walls of the inner vessels of prior art casks were both integrally-formed and cylindrically shaped so that they could withstand the high G forces. Additionally, the basket assemblies were made of large number of relatively thick stainless steel plates to withstand both the hypothetical impact load limit, and to provide the required neutron traps.

Recently, as more and more nuclear power plants are storing spent fuel assemblies on their own grounds, a need has arisen for a specialized, storage-only cask which is capable only of safely storing spent fuel assemblies on above-ground concrete pads. While the weight and structures of such casks should allow them to be easily locally portable on the grounds of the nuclear power plant, and while the surface radiation emanating from such casks should still be less than 200 millirem limit set by the NRC, their internal structure need not be capable of withstanding the high G limit associated with the hypothetical vehicular accident as such casks will not be transported outside of the facility. For such storage-only casks, a G-limit on the order of 20 to 40 G's is all that would be required; simulated by a controlled drop height of less than about one foot. Additionally, safety measures taken in the design of the basket assembly for transportation casks would not apply to storage-only casks.

While it would be possible to use a prior cask to merely store spent fuel assemblies on the grounds of a nuclear power facility the cylindrical shape of the thick iron inner vessel would render them less than optimally efficient with respect to the weight of the shielding materials used. Such inefficiency arises from the fact that the interior of the inner vessels of such casks is rectangular (or at least polygonal) to compliment the shape of the array of rectangular fuel assemblies disposed therein, while the outer walls are cylindrical. Since the maximum amount of permissible surface radiation for such cask is 200 millirems per hour maximum at each point on the cask, the radius of the inner vessel must be made large enough so that this maximum surface radiation level is not exceeded even at the points along the circumference of the cylindrical vessel where the walls of the vessel are the thinnest (which generally occurs at the corner of the rectangular array of fuel assemblies). This minimum shielding requirement in turn causes the walls of the cylindrical inner vessel to be necessarily thicker than they have to be at other points around the circumference of the vessel. In a full sized transportation and storage cask, the use of such cylindrically shaped inner and outer vessels can result in many tons of excessive and unused shielding material in the walls of this cask. Other weight inefficiencies result from the use of relatively heavy stainless steel in the basket assemblies, and the provision of the neutron flux traps between adjacent fuel assemblies. The net result of these two factors is that the basket assemblies used in the prior art are much heavier than they need to be for in-facility storage purposes. Such prior art basket assemblies are also incapable of accommodating a maximum number of fuel assemblies due to the space required for the flux traps. Hence a larger basket is needed when such flux traps are provided, which in turn increases the circumference (and hence the weight) of the surrounding shield walls. Still another shortcoming associated with the use of such prior art casks for in-facility storage purposes is the expense associated with their manufacture. The creation of a cylindrical inner vessel with integrally formed walls which has a rectangular or polygonal interior requires extensive amounts of expensive machining. Moreover, the welding together of the heavy, expensive stainless steel plates used in the basket assembly further adds a considerable amount of expense to the cask as a whole.

SUMMARY OF THE INVENTION

Generally speaking, the invention is a low cost, minimum weight fuel assembly storage cask that eliminates, or at least ameliorates the shortcomings and expenses associated with prior art transportation and storage casks. The cask of the invention generally comprises a wall assembly for defining a cask interior that is polygonal in cross section and complementary in shape to the array of fuel assemblies or other structure to be stored that includes a plurality of flat, metallic wall plate members having mutually parallel and adjoined side edges, a floor plate attached to the bottom of the wall assembly, and a lid detachably connectable to the top of the wall assembly. The thickness of the wall assembly is sufficient to achieve a surface radiation of less than 100 millirems per hour, and the edges of the wall plate members that form the wall assembly of the cask are adjoined by welds which penetrate a distance of less than 50 percent, and preferably only about 10 percent of the total thickness of the wall assembly. While the wall assembly may be formed by laminating a plurality of wall plate members together, only one wall plate member is used to form each side of the resulting wall simplify the construction of the cask. The cross-sectional shape of the wall assembly is typically square or rectangular in order to accommodate a closely packed array of fuel assemblies packed within an egg crate-type basket assembly.

To minimize the weight of the resulting cask, the adjoined side edges of the wall plate members form corners at uniform distances around the periphery of the wall assembly which are truncated to an extent to where the shielding properties of the wall assembly are substantially equal throughout its perimeter. Additionally, the mutually adjacent and adjoined side edges of two different wall plate members include mutually interfitting portions for avoiding the creation of a streaming path for radiation in the interface between said members.

As has been previously indicated, the cask may further comprise a basket assembly that both separates and arranges the fuel assemblies disposed within the interior of the cask wall assembly. This basket assembly may be formed from two sets of parallel and uniformly spaced apart divider plates, and these two sets of plates may be interfitted together in egg crate fashion to form a plurality of storage cells for the fuel assemblies. In the preferred embodiment, parallel and uniformly spaced grooves are provided around the inner walls of the wall assembly for slidably receiving the outer edges of the divider plates that form the basket assembly. The divider plates may be formed from a light-weight and inexpensive alloy of aluminum and boron to insure that no critical nuclear reaction can take place between adjacent fuel assemblies.

While the side plate members may be formed from any weldable and machinable metal, low-carbon steel in plate or casting form is preferred for its low cost, and for its availability in thick-walled sections.

In the construction method of the invention, four metallic, weldable wall plate members, each of which is sufficiently thick to reduce the surface radiation of the resulting cask to less than about 100 millirems per hour, are vertically positioned in abutting relationship around a projecting portion in the floor plate, and then adjoined along their side edges by means of welds that penetrate less than 50 percent of the thickness of the wall plate members, and preferably less than about 10 percent. The method may further include the step of machining interfitting recessed and projecting portions on the side edges of abutting plate members before these members are abutted and welded to eliminate streaming paths for radiation emanated by the array of fuel assemblies disposed within the cask. After the wall plate members have been adjoined; uniformly spaced and parallel grooves may next be provided on the inner surfaces of each of these members for slidably receiving and retaining the outer edges of the plate forming the basket assembly. The edges of the basket assembly may then be slidably inserted in these grooves, and a lid detachably mounted over the open end of the cask.

BRIEF DESCRIPTION OF THE SEVERAL FIGURES

DETAILED DESCRIPTION OF THE PREFERRED EMBODIMENT

Figure 1:
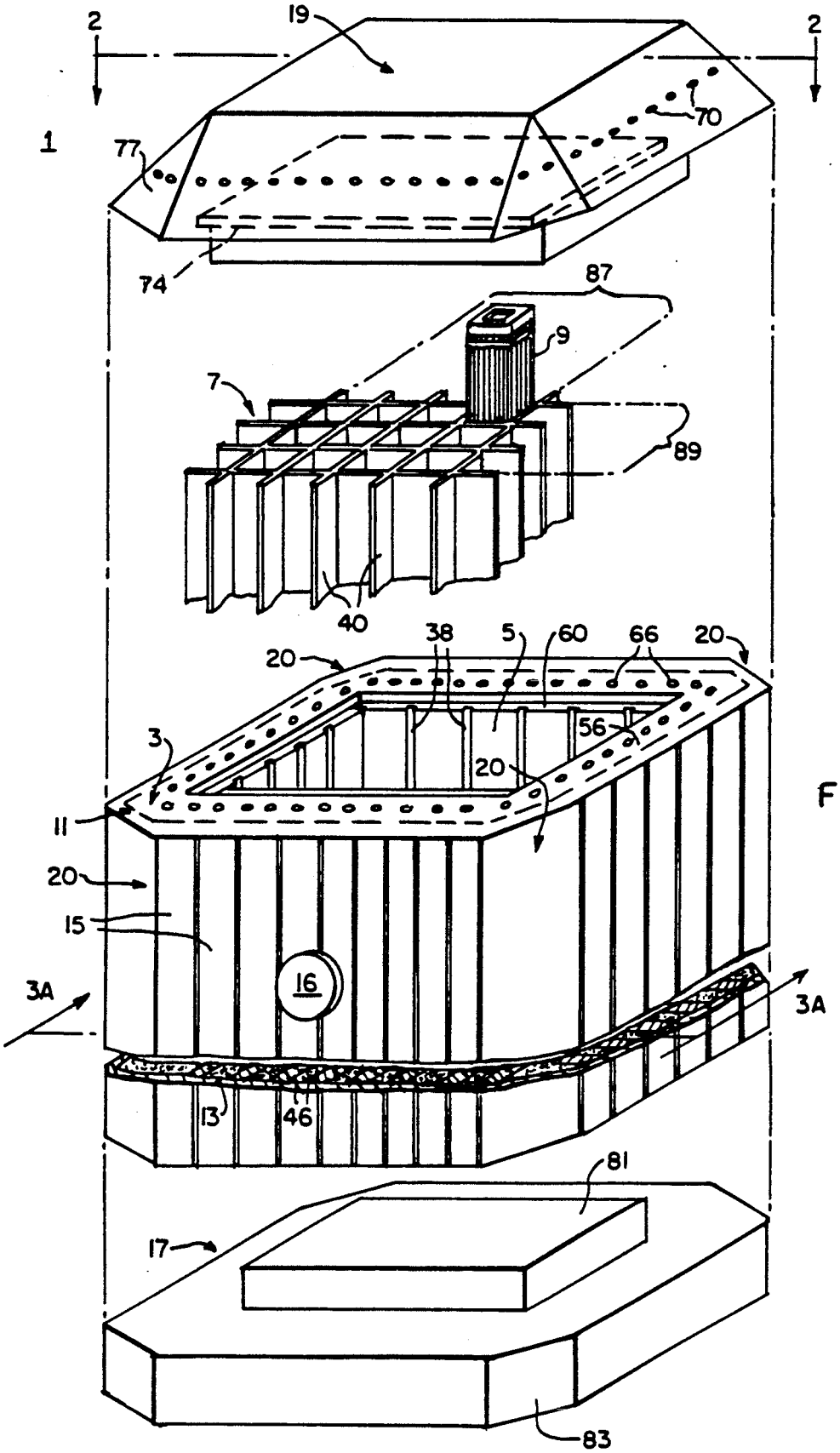
FIG. 1 is an exploded, perspective view of the storage cask of the invention, illustrating how the basket assembly fits into the rectangular interior of the cask, and how the floor plate and lid are assembled over the inner and outer wall assemblies.
Figure 2:
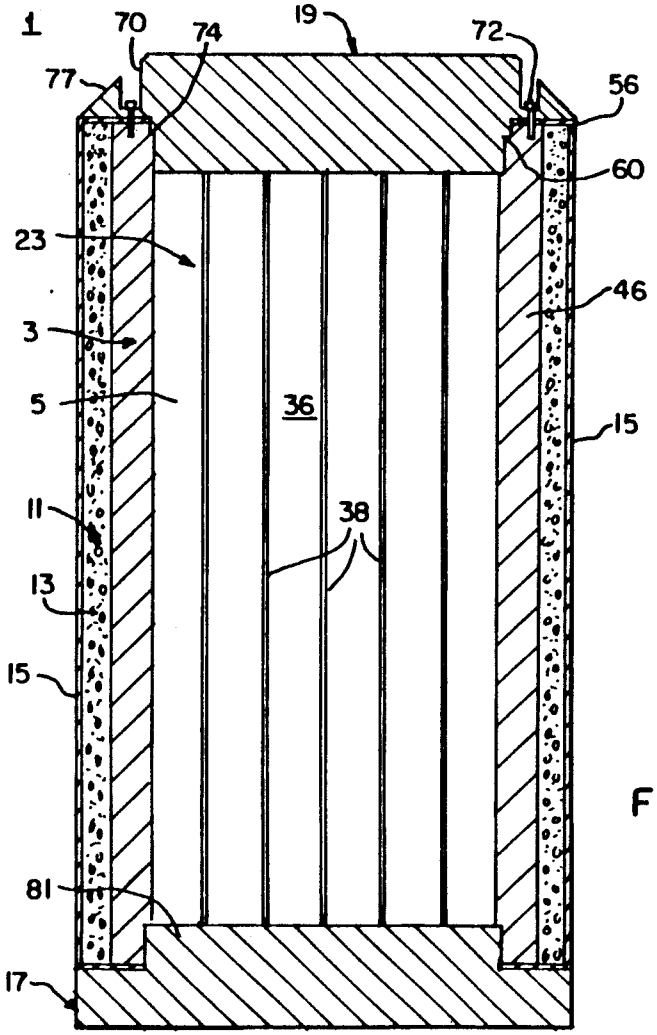
FIG. 2 is a cross-sectional side view of the cask illustrated in FIG. 1 along the line 2—2.

With reference now to FIGS. 1 and 2, wherein like references designate like numerals throughout all of the several figures, the storage cask 1 of the invention generally comprises an inner wall assembly 3 formed from low-carbon steel and having a rectangular interior 5 for receiving a basket assembly 7 that holds and arranges a plurality of spent fuel assemblies 9 in a compact, rectangular configuration that is complimentary in shape to the interior 5 of the cask 1. The cask 1 further includes an outer wall assembly 11 comprising a layer of neutron absorbing, high-hydrogen content concrete 13 which in contained between the outer surface of the inner wall assembly 3, and the inner surface of a plurality of peripheral fins 15 disposed around the perimeter of the cask 1. Generally speaking, the low-carbon steel forming the inner wall assembly 3 reduces gamma radiation emanating from the spent fuel assemblies 9 to an acceptable level on the surface of the cask, while the layer 13 of high-hydrogen concrete lowers neutron radiation from the fuel assemblies 9 to an acceptable level. Upper and lower carrying lugs 16 which are welded directly into the inner wall assembly 3 are provided to facilitate local moving and handling of the cask 1. A floor plate 17 is welded around the bottom perimeters of both the inner and outer wall assemblies 3 and 11 to provided a floor for the cask 1, while a detachable lid 19 provides a water-tight ceiling and roof for the cask 1. It is important to note that the corners 20 of both the inner and outer wall assemblies 3 and 11 are truncated as shown to remove unnecessary shielding weight from the cask 1.

Figure 3A:
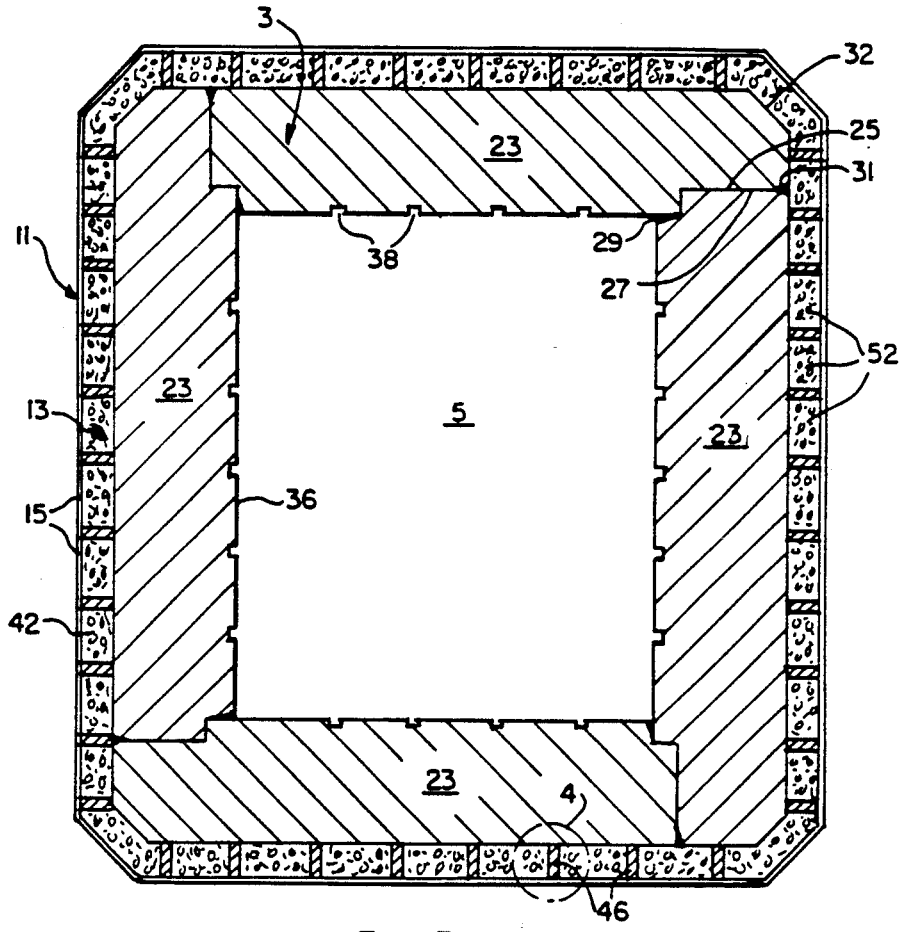
FIG. 3A is a cross-sectional plan view of the cask illustrated in FIG. 1 along the line 3A—3A.

FIG. 3A illustrates the cross-section of a preferred embodiment of the inner wall assembly 3. In this embodiment of the cask 1, each side of the inner wall assembly 3 is formed from a single, solid wall plate member 23. Each of these wall plate members 23 is sufficiently thick to reduce the gamma radiation emanating from the array of spent fuel assemblies 9 in the rectangular interior 5 of the cask 1 to a level of below 100 millirems per hour. In view of the high concentration of fissionable uranium in modern fuel assemblies (for example, initial enrichment of four percent uranium and burnup to 45 GWD/ton,) and the reduction in the amount of time that such fuel assemblies spend in the spent fuel pool of present day nuclear power plant facilities; (for example, five year cooling period) the applicant estimates that the thickness of each of the wall plate members 23 should be about 12 inches of steel to reduce the gamma radiation on the surface of the cask 1 to the desired amount.

Each of the wall plate members includes a recessed side edge 25, and a flanged side edge 27 which interfit in complementary fashion as shown. The provision of such recesses and flanges not only eliminates any straight-line, streaming paths for the radiation emanating from the fuel assemblies 9 disposed in rectangular interior 5 of the cask; it also facilitates the assembly of the cask 1 by helping to hold the edges of the wall plate members 23 together in proper fashion when they are adjoined by welding. In this last regard, it is important to note that the welds used to adjoin the edges of the wall plate members 23 do not penetrate completely through the thickness of these members. Instead, only two relatively shallow welds are used, including an inner weld 29 which may be only a quarter of an inch deep, and an outer weld 31 which is preferably about three quarters of an inch deep. The combination of the inner and outer welds 29 and 31 effectively seals the crevices presented between the interface of the adjoining wall plate members 23 so that water or contained inert gas during storage cannot leak therein from either the outside or the inside of the wall assembly 3, and further adjoins the wall plate members 23 with a bond which is strong enough to withstand the 20 to 40 G maximum load limit that is required of a cask 1 which is used only for on-site storage. To facilitate the creation of the inner and outer welds 29 and 31, all of the wall plate members 23 are preferably formed from a low-carbon steel, a metal which is not only easily weldable, but also strong, inexpensive, and easily machined. The recessed side edge 25 of each of the wall plate members preferably includes a truncated portion 32 for reducing the weight of the inner wall assembly 3 in particular, and the storage cask 1 in general. Such a truncation may be made without compromising the shielding effectiveness of the inner wall assembly 3 since the radiation emanated by the fuel assemblies 9 travels radially with respect to the center line of the rectangular interior 5, and since the amount of shielding that the truncated portion applies to such radiation is the same (or slightly greater than) the amount of shielding provided through the midportion of any wall plate members 23.

Figure 3B:
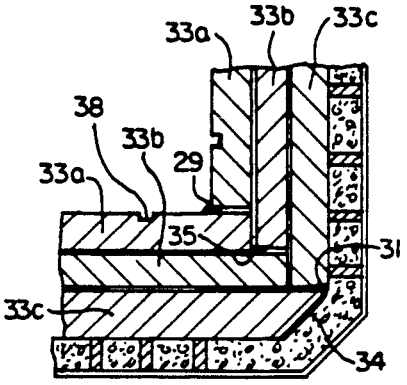
FIG. 3B illustrates the structure of an alternative embodiment of the inner wall assembly of the cask, wherein the assembly is formed from laminated wall plate members.

FIG. 3B illustrates an alternative embodiment of the inner wall assembly 3 of the invention which utilizes laminated wall plate members 33*a,b,c*. Like the previously described single wall plate members 23, the inner wall assembly 3 formed from the laminated wall plate members 33*a,b,c* is held together by inner and outer welds 29 and 31, as well as a central weld 35 (which secures together intermediate wall plate members 33*b*). Again, none of the welds 29, 31, or 35 penetrates the entire thickness of any of the laminated wall plate members 33*a,b,c*. However, inner weld 29 is disposed on the inside corner of the abutting plates 33*a* in order to seal the interior 5 of the resulting wall assembly 3, while outer weld 31 is positioned along the outer surfaces of the laminated wall plate members 33*c* in order to seal the exterior of the resulting wall assembly 3 from water or other fluids. In this embodiment, the thickness of each of the laminated wall plate members 33*a,b,c* is approximately four inches, while the depth of each of the welds 29, 31 and 35 is approximately one-half inches. The outer corner 34 of the laminated wall plate members 33*c* is truncated as shown. The zig-zag path that results between the abutting laminated wall plate members 33*a,b,c* affords a tortuous path for radiation emanating from the fuel assemblies 9 disposed within the interior 5 of the wall assembly 3 that prevents unwanted streaming.

Figure 4:
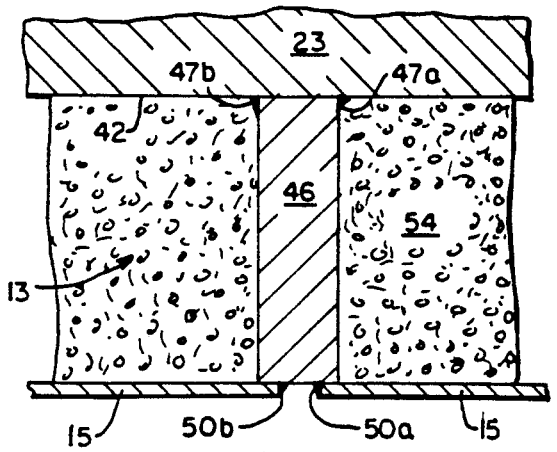
FIG. 4 is an enlargement of the portion of FIG. 3A enclosed by the dotted circle.

With reference now to FIGS. 1, 2 and 4, the inner surface 36 of the wall assembly includes a plurality of parallel and uniformly spaced grooves 38. These grooves 38 slidably receive the outer edges 40 of the basket assembly 7. The outer surface 42 of the inner wall assembly 3 abuts the outer wall assembly 11, which is formed from a plurality of parallel, uniformly spaced heat conducting ribs 46 in combination with the aforementioned cement layer 13 and peripheral fins 15.

With specific reference now to FIG. 4, the proximal edges of the heat conducting ribs 46 are each secured onto the outer surface 42 of the inner wall assembly 3 by a pair of welds 47*a,b* which secure the ribs at right angles to the surface 42. The side edges of each of the peripheral fins 15 are in turn secured onto the distal edges of the heat conducting ribs 46 by means of welds 50*a,b* as shown. Both the heat conducting ribs 46 and the peripheral fins 15 are each preferably formed from the same low-carbon steel as the wall plate members 23 to facilitate welding therebetween. As best seen with reference to both FIGS. 3*a* and 4, when the welds 47*a,b* and 50*a,b* and all completed, a plurality of cement-receiving cells 52 are defined between the outer surface 42 of the inner wall assembly 3, the inner surfaces of the peripheral fins 15, and the side surfaces of each of the heat conducting ribs 46. As will be described in more detail hereinafter, high-hydrogen cement 54 is poured into the cement receiving cell 52 after the construction of the inner and outer wall assemblies 3 and 11 has been completed and after the floor plate 17 has been secured around the bottom of these assemblies. The purpose of the heat conducting ribs 46 and peripheral fins 15 is to dispel the heat generated by the break down of the radial isotopes within the spent fuel assemblies 9 which occupy the interior 5 of the cask 1. The advantages associated with the use of peripheral fins 15 in lieu of radially-oriented fins is set forth with specificity in co-pending U.S. patent application Ser. No. 07/421,262 filed Oct. 13, 1989, now U.S. Pat. No. 4,997,618, and entitled "Fuel Rod Shipping Cask Having Peripheral Fins" by Larry E. Efferding and assigned to the Westinghouse Electric Corporation, the entire specification of which is expressly incorporated herein by reference.

Figure 5:
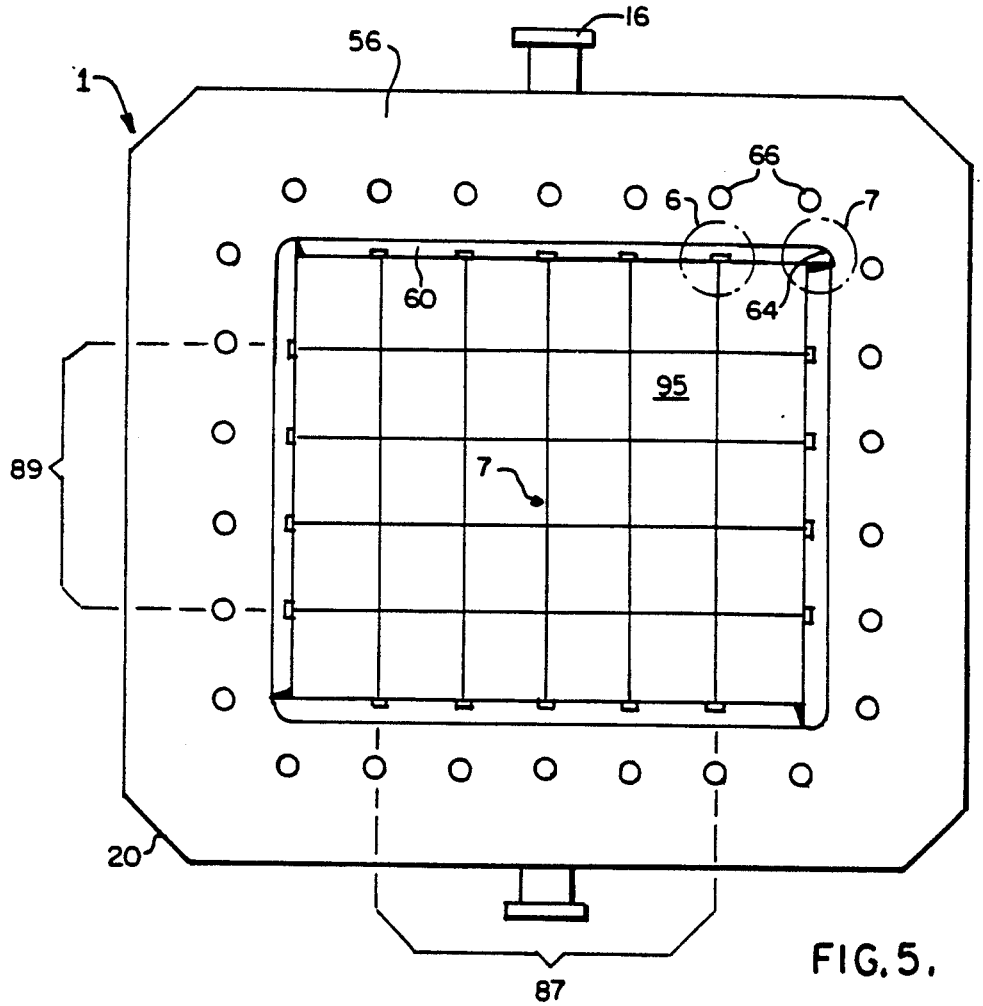
FIG. 5 is a plan view of the cask illustrated in FIG. 1 with the lid removed.
Figure 6:
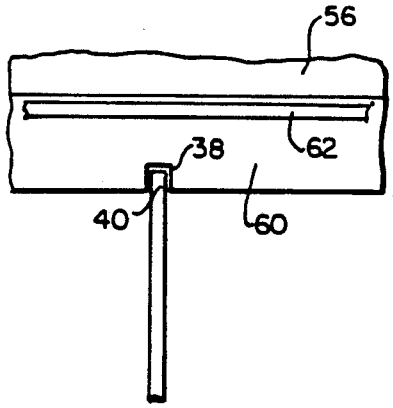
FIG. 6 is an enlargement of the portion of FIG. 5 enclosed by the dotted circle numbered "6"
Figure 7:
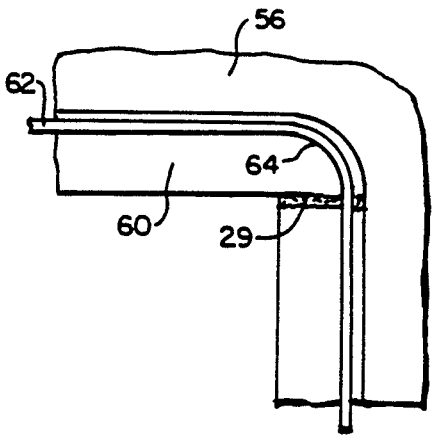
FIG. 7 is an enlargement of the portion of FIG. 5 enclosed by the dotted circle labeled "7"

The top ends of each of the cement receiving cells 52 are covered by means of a cap plate 56 best seen in FIG. 5. Both the inner and outer edges of the cap plate 56 are securely welded around the upper edges of the peripheral fins 15 and the upper edge of the inner surface 36 of the inner wall assembly 3 in order to completely seal the cement-receiving cells 52 from water or other fluids. To assist the lid 19 in effecting a water-tight seal around the upper edge of the inner and outer wall assemblies 3,11 the cap plate 56 further includes a ledge 60 which has circumscribed by a resilient gasket 62. Because the gasket material that forms the gasket 62 cannot be made with square corners, the corners 64 of the ledge 60 are preferably rounded along about a 2 inch radius. A plurality of uniformly spaced bolt holes 66 are provided around the cap plate 56 between the ledge 60, and its outer edge. With reference again to FIG. 1, these bolt holes 66 are registrable with a plurality of uniformly spaced bolt holes 70 present around the outer edge of the lid 19. The lid 19 further includes a sealing flange 74 which is received within the ledge 60 at the upper end of the cap plate 56 when the lid 19 is lowered over the cap plate 56. Bolts 72 are used to secure the lid 19 onto the cap plate 56. To remove unnecessary weight from the storage cask 1, the corner 77 of the lid 19 are not just truncated, but are beveled as shown.

With reference again to FIG. 1, the floor plate 17 includes a rectangular or square projection portion 81 which is complementary in shape to the rectangular interior 5 of the inner wall assembly 3 and is received therein during the construction of the cask 1. As has been mentioned before, the floor plate 17 is secured onto both the inner and outer wall assemblies 3 and 11 by welds (not shown) disposed between the outer edges of the projecting portion 81 and the inner surface 36 of the inner wall assembly 3, and welds between the bottom edges of the peripheral fins 15 and the upper, outer edge of the base of the floor plate 17. The corners 83 of the floor plate 17 are truncated to conform with the truncated corners of the body of the cask formed by the inner and outer wall assemblies 3 and 11. While these corners 83 could be beveled in the same fashion as the corner 77 of the lid 19, such a beveling would compromise the stability of the cask 1 by making it easier to topple over in the event of a seismic disturbance or accident. Accordingly, the corners 83 are truncated but not beveled to enhance the stability of the cask 1 when it stands on the floor plate 17.

Figure 8:
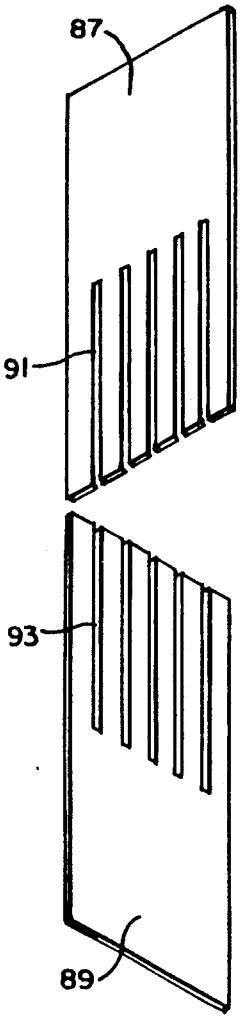
FIG. 8 is a perspective view of two of the divider plates that form the basket assembly of the cask, illustrating how these plates interfit together in egg crate fashion.

With reference now to FIGS. 1 and 8, the basket assembly 7 is formed from two sets 87 and 89 of parallel and uniformly spaced apart plates. As is best seen with reference to FIG. 8, the plates of different sets 87 and 89 each include mutually interfitting slots 91 and 93 so that the sets of plates 87 and 89 interfit in egg-crate fashion to form a plurality of cells 95 which are dimensioned very closely to the square perimeters of fuel assemblies 9. Because the cask 1 does not have to withstand the 150 G impact limit associated with a transportation cask, no neutron flux traps need be provided between the adjacent fuel assemblies 9. Moreover, borated aluminum may be used for the parallel set of divided plates 87 and 89 instead of the relatively heavy and expensive stainless steel used in prior art casks.

In the construction method of the invention, the floor plate 17 of the cask is first provided. Next, each of the wall plate members 23 is machined from low-carbon steel such that each member includes a recessed side edge 25 and a flanged side edge 27 of complementary shape. Next, the bottom edges of the wall plate members 23 are craned into place around the outer edge of the floor plate 17 so that the recessed and flanged side edges 25,27 of each member 23 fits in complementary fashion with the recessed and flanged side edges 25 and 27 of an adjacent plate 23. The four wall plate members 23 are then preferably temporarily secured together in proper position by means of resilient banding material, (not shown) placed around the outer surface 42 of the wall assembly 3 in tension. Thus positioned, the wall plate members 23 are all joined by means of the previously described inner weld 29, and then by means of the outer weld 31. Additionally, the bottom edges of each of the wall plate members 23 are joined to the outer edge of the projecting portion 81 of the floor plate 17. In the next step of method of construction, the heat conducting ribs 46 are attached around the outer surface 42 of the inner wall assembly 3 by means of the aforementioned welds 47*a,b*. Additionally, the bottom edges of these ribs 46 are attached to the outer edge of the floor plate 17 by means of other welds (not shown).

In the final stages of the construction method of the invention, the peripheral fins 15 are secured to the proximal ends of the heat conducting ribs 46 by means of welds 50*a,b* which extend the full length of the fins 15. The bottom edges of each of the fins 15 are welded around the outer edge of the floor plate 17 in the manner previously indicated. Once these steps have been accomplished, a plurality of water-tight, cement receiving cells 52 have been formed around the periphery of the cask 1. High-hydrogen cement is then poured into each of these cells 52. After the cement has been given an opportunity to thoroughly dry, the cap plate 56 is placed over the top edges of the inner and outer wall assemblies 3 and 11, and is welded along its inner and outer edges to secure it to the rest of the cask structure. Grooves 38 are then provided around the inner surface of the inner wall assembly 3. 20 After this has been completed, the basket assembly 7 is assembled from the previously described sets of parallel, slotted divider plates 87 and 89. The slotted divider plates 87,89 are individually inserted into the rectangular interior 5 of the wall assembly 3 using grooves 38 to act as guides to provide easy and rapid insertion. After all the divider plates 87,89 are installed in position in the cask interior 5, they are welded with remote-welding devices, commercially available, which are inserted into the cell openings to apply an intermittent weld to each joint over the length of the plates 87,89. The basket assembly 7 is thus, "rigidified" in situ using the previously-fabricated cask 1 as a fixture to form the basket configuration thus saving considerable cost in manufacture. After spent fuel assemblies 9 have been lowered into each of the cells 95 defined within the basket assembly 7, the lid 19 is lowered over the cap plate 56 so that its sealing flange 74 is received within the ledge 60 and over the gasket 62. The lid 19 is then secured in this position by means of bolts 72.

I claim:

1. A cask for the storage of a radioactive structure having a polygonal cross-section, comprising:

a shield wall assembly for defining a cask interior that is polygonal in cross-section and complementary in shape to said structure, consisting of a plurality of flat metallic wall plate members having uniform thicknesses and mutually parallel and adjoined side edges;

a floor plate attached to the bottom of said wall assembly, and a lid detachably connectable to the top of the wall assembly.

2. A cask for storage as defined in claim 1, wherein the radioactive structure is an array of fuel assemblies, and wherein the thickness of said wall assembly is sufficient to achieve a surface radiation of less than 100 millirems per hour.

3. A cask for storage as defined in claim 1, wherein the walls of said wall assembly are formed by laminating a plurality of layers of metallic wall plate members.

4. A cask for storage as defined in claim 3, wherein the side edges of adjacent wall plate members in the same layer are adjoined by welds.

5. A cask for storage as defined in claim 4, wherein the welds that adjoin adjacent wall plate members on the same layer extend partially through the thickness of said plate members.

6. A cask for storage as defined in claim 4, wherein the welds that adjoin adjacent wall plate members on the same layer extend only about halfway through the thickness of said plate members.

7. A cask for storage as defined in claim 1, wherein each wall of said wall assembly is formed from a single wall plate member, and wherein the mutually parallel side edges of adjacent wall plate members are adjoined by welds that do not penetrate more than about 20 percent of the total thickness of the all plate members.

8. A cask for storage as defined in claim 1, wherein the adjoined side edges of the wall plate members form corners at uniform points around the periphery of the wall assembly, and wherein each of said corners is truncated to an extent to where the shielding properties of the wall assembly are substantially equal at said corners and the central portions of said side plate members in order to reduce the weight of the cask.

9. A cask for storage as defined in claim 1, wherein said wall plate members are formed from low carbon steel.

10. A cask for storage as defined in claim 3, wherein each wall of said wall assembly is formed from a lamination of not more than three wall plate members 11. A cask for storage as defined in claim 7, wherein mutually adjacent and adjoined side edges of two different wall plate members include mutually interfitting portions for avoiding the creation of a streaming path for radiation in the interface between said members.

12. A cask for the storage of an array of radioactive structures, said array having a polygonal cross-section, comprising:

a shield wall assembly for defining a cask interior that is complementary in shape to said array of radioactive structures, consisting of a plurality of discrete and flat metallic wall plate members having mutually parallel side edges, said side edges being adjoined by welds that penetrate only part way through the thicknesses of the wall plate members;

a floor plate attached to the bottom of said wall assembly, and a lid detachably connectable to the top of said wall assembly.

13. A cask for storage as defined in claim 12, wherein mutually adjacent and adjoined side edges of two different wall plate members include mutually interfitting portions for avoiding the creation of a streaming path for radiation in the interface between said members.

14. A cask for storage as defined in claim 13, wherein said mutually interfitting portions are substantially complementary so that the radioactive shielding afforded by the interface between adjoining plate members is no less than the shielding afforded through the thicknesses of said plate members.

15. A cask for storage as defined in claim 12, wherein each of the walls of said wall assembly is formed from a plurality of layers of said wall plate members.

16. A cask for storage as defined in claim 12, wherein each of the walls of said wall assembly is formed from a single member, and the thicknesses of said plate members are substantially equal, and afford sufficient shielding from the radiation emitted by the radioactive structures to reduce the surface radiation to at least 100 millirems per hour.

17. A cask for storage as defined in claim 12, further comprising a basket assembly for both separating and arranging said radioactive structures.

18. A cask for storage as defined in claim 17, wherein said basket includes a plurality of divider plates, each of which terminates in an outer edge around the periphery of the basket, and wherein the inner surfaces of the wall plate members include grooves for receiving said outer edges.

19. A cask for storage as defined in claim 18, wherein said divider plates are formed from an alloy of aluminum and boron.

20. A cask for storage as defined in claim 12, wherein the side edges of adjacent side plate members are adjoined to one another by both an inner and an outer weld that are located on the interior and the exterior of the wall assembly, respectively, in order to seal the interface and strengthen the bond between said side plate members.

21. A cask for the storage of a rectangular array of spent fuel assemblies, comprising:

a shield wall assembly for defining a rectangular cask interior that is complementary in shape to the array of spent fuel assemblies, consisting of a plurality of discrete and flat metallic wall plate members, wherein each wall of said wall assembly is formed from a single wall plate member having a thickness sufficient to reduce the surface radiation of the assembly to below 100 millirems per hour when the array of spent fuel assemblies is disposed therein, said wall plate members having mutually parallel side edges adjoined by welds that penetrate only part way through the thickness of the wall plate members;

a floor plate attached to the bottom of said wall assembly, and a lid detachably connected to the top of said wall assembly.

22. A cask for storage as defined in claim 21, wherein the welds that adjoin the side edges of two different wall plate members penetrate a total of only about 20 percent through the thickness of said members.

23. A cask for storage as defined in claim 21, wherein the welds that adjoin the side edges of two different wall plate members extend a total of only about 10 percent through the thickness of said members 24. A cask for storage as defined in claim 21, wherein mutually adjacent and adjoined side edges of two different wall plate members include mutually interfitting portions for avoiding the creation of a streaming path for radiation in the interface between said members, and for facilitating the manufacture of the wall assembly.

25. A cask for storage as defined in claim 24, wherein the side edge of one of said side wall members includes a recess and the side edge of the side wall member that adjoins it includes a projecting portion that interfits with said recess, wherein the interface between said recess and projecting portion defines a broken path with respect to the direction that radiation is emitted from said array of fuel assemblies.

26. A cask for storage as defined in claim 21, further comprising a basket assembly for both separating and arranging said radioactive structures.

27. A cask for storage as defined in claim 26, wherein said basket includes a plurality of divider plates, each of which terminates in an outer edge around the periphery of the basket, and wherein the inner surfaces of the wall plate members include grooves for receiving said outer edges.

28. A cask for storage as defined in claim 27, wherein said basket assembly includes first and second sets of parallel and uniformly spaced apart plates, the first set being orthogonal to and interfitting with the first in egg-crate fashion, for defining an array of square cells, each of which receives one of said array of fuel assemblies.

29. A cask for the storage of a rectangular array of spent fuel assemblies, comprising:

a shield wall assembly for defining a rectangular cask interior that is complementary in shape to the array of spent fuel assemblies, consisting of four low carbon steel wall plate members, each of which has a thickness sufficient to reduce the surface radiation of the assembly to below 100 millirems per hour when the array of spent fuel assemblies is disposed therein, and each of which forms a single wall of said wall assembly, said wall plate members having mutually parallel side edges adjoined by inner and outer welds located on the interior and exterior of the wall assembly, respectively, wherein the aggregate depth of the welds between any two side members is less than 20 percent of the thickness of the side members, and wherein mutually adjacent and adjoined side edges include mutually interfitting portions for avoiding the creation of a streaming path for radiation in the interface between said side members;

a basket assembly disposed in the interior of the wall assembly, including first and second sets of parallel, uniformly spaced divider plates, said first and second sets of plates being interfittable in egg crate fashion and disposed orthogonally to define a rectangular array of cells for receiving spent fuel assemblies, the perimeter of said basket assembly being defined by the outer edges of said divider plates and said outer edges being slidably received in parallel and uniformly spaced grooves present in the inside surfaces of the wall plate members forming the wall assembly;

a floor plate attached to the bottom of said wall assembly, said floor plate having a raised rectangular projection in its central portion that is receivable in the bottom of the rectangular interior defined by the wall assembly, and a lid detachably connected to the top of said wall assembly.

30. A cask for storage as defined in claim 29, further comprising a plurality of parallel, heat conducting ribs attached around the exterior of the wall assembly and a plurality of peripherally oriented heat conducting fin members attached between said ribs, and a layer of neutron absorbing material disposed in the spaces defined between said parallel ribs, the exterior of said wall assembly and the interior surfaces of said peripherally oriented fin members.

31. A cask for storage as defined in claim 29, wherein said divider plates are formed from an alloy of aluminum and boron.

32. A cask for storage as defined in claim 29, wherein said mutually interfitting portions between adjacent side plate members are complementary in shape.

33. A cask for storage as defined in claim 29, wherein the corners formed by adjoined side plate members are truncated so that the amount of radiation emitted through the corners of the side plate members and their central portions is the same.

34. A method for constructing a storage cask for an array of radioactive structures having a rectangular cross-section from four metallic, weldable wall plate members, each of which is sufficiently thick to reduce the surface radiation of the resulting cask to less than about 100 millirems per hour when said structures are loaded therein, comprising the step of:

abutting and adjoining the side edges of each of said wall plate members to form a shield wall assembly having an interior that is complementary in shape to the exterior of said array of radioactive structures, and two open ends, wherein the side edges are adjoined by welds that penetrate less than 50 percent of the thickness of the wall plate members.

35. A method for constructing a storage cask as defined in claim 34, wherein said side edges are joined by first and second welds located on the inner and the outer surface of said wall assembly, the total thickness of said two welds being less than 20 percent of the thickness of the wall plate members.

36. A method for constructing a storage cask as defined in claim 34, further including the step of machining in recessed and projecting portions on the side edges of abutting wall plate members to eliminate streaming paths for the radiation emanated by the array of radioactive structures.

37. A method for constructing a storage cask as defined in claim 34, further including the step of providing uniformly spaced and parallel grooves on the inner surfaces of each of the wall plate members for slidably receiving and retaining the outer edges of plates forming a basket assembly.

38. A method for constructing a storage cask as defined in claim 37, further including the steps of securing a floor plate to one of the open ends of said wall assembly.

39. A method for constructing a storage cask as defined in claim 38, further including the step of assembling a basket assembly in the interior of the wall assembly by sliding in divider plate in said grooves, and welding together abutting edges of different divider plates.

40. A method for constructing a storage cask as defined in claim 39, wherein said divider plates have interfitting slots, and further including the step of interfitting said plates together in the interior of the wall assembly prior to welding together abutting edges of different divider plates.

* * * * *